United States Patent [19]

Bernewasser

[11] Patent Number: 4,594,954

[45] Date of Patent: Jun. 17, 1986

[54] SEWING DEVICE WITH A SEWING HEAD INCLUDING A ROTARY HOUSING

[75] Inventor: Horst Bernewasser, Steinhagen, Fed. Rep. of Germany

[73] Assignee: Kochs Adler, AG, Bielefeld, Fed. Rep. of Germany

[21] Appl. No.: 702,039

[22] Filed: Feb. 15, 1985

[30] Foreign Application Priority Data

Mar. 27, 1984 [DE] Fed. Rep. of Germany ..... 3411178

[51] Int. Cl.[4] ..... D05C 21/00; D05C 9/04

[52] U.S. Cl. ..... 112/121.15; 112/102; 112/308

[58] Field of Search ..... 112/121.15, 119, 102, 112/103, 308, 238

[56] References Cited

U.S. PATENT DOCUMENTS

| | | | |
|---|---|---|---|
| 1,049,520 | 1/1913 | Noble . | |
| 3,497,780 | 2/1970 | Leenhouts | 112/102 UX |
| 3,515,080 | 6/1970 | Ramsey | 112/102 X |
| 4,088,085 | 5/1978 | Hager | 112/121.15 X |
| 4,347,797 | 9/1982 | Scholl et al. | 112/121.15 X |
| 4,373,458 | 2/1983 | Dorosz et al. | 112/121.12 |

FOREIGN PATENT DOCUMENTS 1158800 1/1962 Fed. Rep. of Germany .

*Primary Examiner*—Ronald Feldbaum

*Attorney, Agent, or Firm*—Laff, Whitesel, Conte & Saret

[57] ABSTRACT

A sewing device having a sewing head including a rotary housing and a control device for controlling the rotary movement of the housing and for generating a two-axis-relative movement between the workpiece to be sewn and the rotary housing. The latter is tiltable about the needle axis and pivoted by means of a hollow shaft. Within the rotary housing there are arranged a needle bar with a needle reciprocatingly driven by a crank, a thread take-up lever for handling a needle thread and drive means for operably moving up and downwardly a presser foot and occasionally a thread tensioner. In order to supply the required drive means inside of the rotary housing with energy without obstruction of the rotatability of the rotary housing there is provided a rotary coupling concentrically arranged with respect to the hollow shaft, at which the rotary coupling is also formed with an coaxial bore for the needle thread. The energy to be supplied can be pressurized air which also can be used to operate a Venturi-nozzle as to bring in the needle thread into the bore.

7 Claims, 11 Drawing Figures

SEWING DEVICE WITH A SEWING HEAD INCLUDING A ROTARY HOUSING

FIELD OF THE INVENTION

The present invention generally relates to a sewing device with a sewing head including a rotary housing, which renders possible the generation of a stitch contour according to a predetermined profile in a workpiece by means of a tangentially controlled feed movement with respect to the individual sewing direction, at which a control is provided for controlling the rotary movement of the housing and for generating a two-axis-relative movement between a workpiece and the rotary housing. In particular, the invention relates to the sewing head including the rotary housing receiving a needle bar with a needle reciprocatingly driven by a crank drivably connected to the main drive shaft of the sewing head, at which in the rotary housing is received a drive for an up and downwardly movable presser foot and at which the rotary housing is rotatably arranged about the needle axis by a hollow shaft through which a needle thread coming from a thread supply is fed and through which is fed a supply line for feeding energy as to operate the presser foot into the rotary housing.

BACKGROUND OF THE INVENTION

German Patent No. 1 158 800 describes a sewing device of such type is known, at which at an arm of the sewing head there is arranged a rotary housing and a hook bearing receiving a hook, at which both, the rotary housing and the hook bearing are uniangularly drivable. Into the rotary housing a needle thread is fed concentrically to the axis of rotation. From this document it is not realisable how the thread guiding is accomplished after entering the rotary housing. Furthermore, it is not realisable how the drive means for operating the presser foot resp. the presser foot bar is supplied with energy.

U.S. Pat. No. 1,049,520 describes a sewing machine for embroidering, at which a needle, a hook and a presser foot are rotatably arranged about the longitudinal axis of the needle. In order to transmit axial movements there are provided slide rings having grooves operating with actuating cams which serve for feeding in axial drive movements from a stationary part of the machine onto a rotatable part of the machine. In such manner, for example, the up and down movements of the presser foot and the movement for driving the needle bar are transmitted. Such a transmission of forces requires a clearance between the cooperating drive elements so that only relative low RPM-rates essentially lower than 1000 RPM as sufficient at embroidery machines are achievable only due to such kind of construction. Furthermore, such kind of force transmission cannot be constructed with low frequency noise generation which however must be guaranteed if the movements must be performed in synchronism with stitch formation. As in addition to this such constructive embodiments of force transmission are exposed to relative high wear, a sufficient lubrication must be assured as this, for example, could be accomplished by means of a closed machine housing.

U.S. Pat. No. 4,373,458 describes a two needle sewing machine, at the sewing head of which is arranged a rotary housing comprising the needle bars, at which the rotary housing is uniangularly drivable together with hook bearing as to render possible a so called tangential sewing. The threads are supplied from the stationary part of the sewing head. Due to this construction the rotatability of the rotary housing is exposed to a certain limitation as the threads on their paths from the takeup lever to the feed-in into the splitted needle bars can cross each other resp. can be twisted about each other at corresponding rotation of the rotary housing. A presser foot bar is spring-loaded and operably actuated by means of a grooved collar, which is operated by a pneumatic cylinder provided in the stationary part of the rotary housing.

SUMMARY OF THE INVENTION

It is an object of the present invention to provide a sewing device having a rotary housing incorporating drives which drives can be supplied with energy without the obstruction of the rotatability of the housing.

Another object of the invention is to render possible the energy supply in kind of electricity, pressurized liquid or gas as to be free in the selection of the drives for different functions.

A further object of this invention is to facilitate the threading into resp. through the rotary housing of the thread coming from a supply as a spool and leading to the thread take-up mechanism.

Still a further object of this invention is to provide a refinement of the described type of sewing device according to the aforesaid objects by a space-saving and rigid construction.

The present invention provides a rotary coupling concentrically arranged with respect to the hollow shaft at which the rotary coupling is also formed with a coaxial bore for the needle thread. The energy to be supplied can be pressurized air which also can be used to operate a Venturi-nozzle in order to bring the needle thread into the bore.

Other objects, advantages and features of the present invention will appear from the detailed description of the preferred embodiment, which now will be explained in conjunction with the accompanying drawings.

DESCRIPTION OF THE PREFERRED EMBODIMENT

Figure 1:
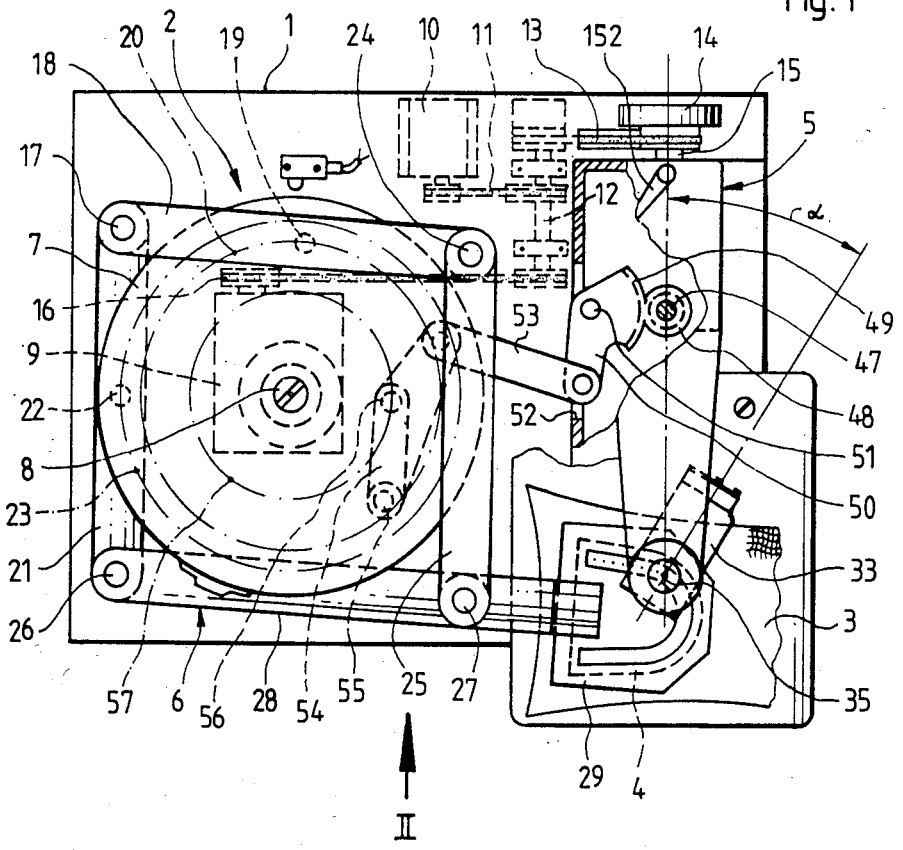
FIG. 1 is a top plan view of an automatic sewing device for attaching pocket cuts onto a workpiece.

Referring to the drawings there is illustrated an automatic sewing device mounted to a stand or base 1 having movable thereon a feeding device 2 and a sewing head 5. The feeding device 2 feeds a workpiece 3 and a workpiece cut 4 to be sewn to the workpiece.

The feeding device 2 is provided with a link system 6, which, in principle, defines a link square cooperating with a control cam 7. The control cam 7 is mounted to an off-drive shaft 8 of a gear 9 fastened to the stand 1. The control cam 7 is rotatably driven via the gear 9 which is turned by a drive motor 10. The drive motor 10 drives, via a belt drive 11, an intermediate drive or shaft 12, which in turn drives, via a further belt drive 13, a main drive shaft 15 of the sewing head 5. The outer end of the main drive shaft 15 has connected thereto a hand wheel 14. A third belt drive 16 connects the intermediate drive 12 with the gear 9.

The link system 6 has a stationary point of rotation defined by an axis 17, which is fixedly attached to the stand 1. One end of a lever 18 is pivotally or swingably connected to the axis 17. The lever 18 extends above the control cam 7 and is substantially vertical or perpendicular to the main direction of the sewing head 5. The lever 18 has a cam follower 19 that engages a groove 20 located in the upper surface of the control cam 7.

A second lever 21 is pivotally connected to the axis 17. The lever 21, extends below the control cam 7 and extends substantially vertical or perpendicularly to the upper lever 18, i.e. parallel with the main direction of the sewing head 5. Also lever 21 has a cam follower 22 for engaging a groove 23 formed in the lower surface of the control cam. The grooves 20 and 23 extend as closed curves around the whole periphery of the control cam 7. The grooves 20 and 23 are not circularly profiled.

The other end of the upper lever 18 is linked or connected to one end of an intermediate lever 25, via a link 24. The intermediate lever 25 extends above the control cam 7 and is substantially parallel to the lower lever 21. The other ends of the lower lever 21 and the intermediate lever 25 are linked or connected via links 26 and 27 to an off-drive lever 28 extending parallel to the upper lever 18. The off-drive lever 28 is located below the control cam 7. As obvious from FIG. 1, the link system 6 defined by the four joints 17, 24, 26, 27 is formed as a rectangular parallelogram with almost equal legs. To the off-drive lever 28 there is connected a workpiece holder 29 for receiving the workpiece 3 and the workpiece cut 4. The automatic sewing device is described above in principle as known from the U.S. Pat. No. 4,347,797.

The sewing head 5 has a vertically extending standard 30. An upper arm 31 and the lower base plate 32 extend in a horizontal plane from the standard 30. A rotary housing 33 is swingably supported about an axis 34 on the lower surface of the free end of the upper arm 31. In the axis 34 there is also arranged a needle bar 36 carrying a needle 35. The rotary housing 33 is fastened by screws 37 to a flange 38 of a hollow shaft or axle 39. The hollow shaft 39 extends into the upper arm 31 coaxially with the axis 34 and is supported in a bearing 40. A first timing belt pulley 41 is attached to the hollow shaft 39 by a key-slot connection 42. A first timing belt 43 drivingly connects the timing belt pulley 41 to a second timing belt pulley 44. The second timing belt pulley is attached to an upper end of a shaft 47. The shaft 47 is supported in the standard 30 by bearings 45, 46, therein. The lower portion of the shaft 47 carries a gear wheel 48. Referring to FIG. 1, an angle lever 50 is swingably connected via a connecting lever 53 to a control lever 54. The control lever 54 is supported about a stationary axis of rotation 55 located in the stand 1. One end of the angle lever has a tooth segment 49 that meshes with the gear wheel 48. The angle lever 50, in the area between the standard 30 and the base plate 32, is pivoted about an axis of rotation 51 and guided through an opening 52 in the base plate 32. The control lever 54 has supported thereon a cam follower 56 engaging a closed groove 57 formed at the lower surface of the control cam 7. The aforesaid described drive 58 drives the rotary housing 33 synchronously with respect to the drive of the workpiece holder 29, so that, as still described hereinafter, the needle 35 moves always tangentially with respect to the course of the seam.

Figure 3:
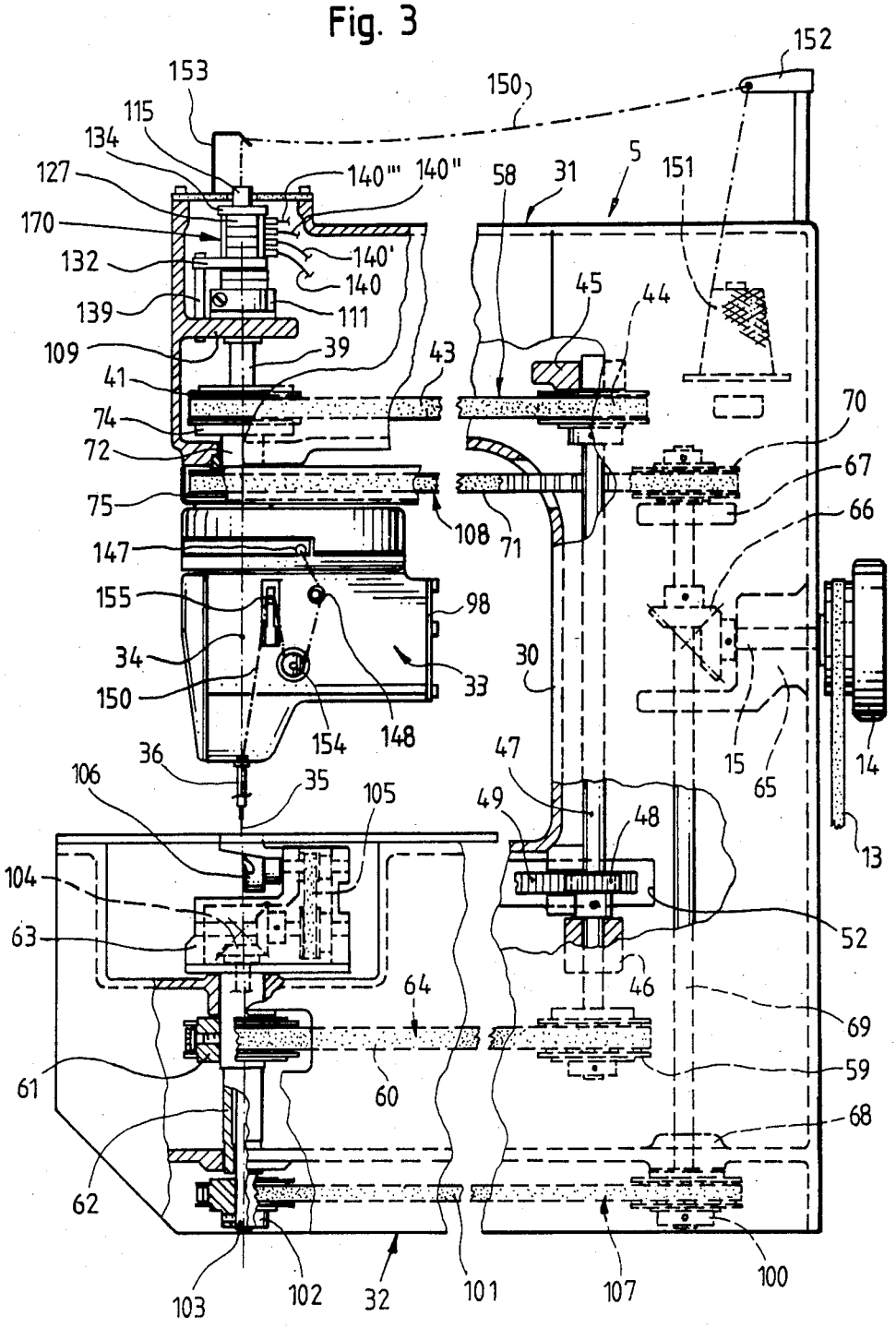
FIG. 3 shows the sewing head of the automatic sewing device according to the arrow III in FIG. 2, with the rotary housing swung into a neutral position, on an enlarged scale with respect to FIGS. 1 and 2.

Referring to FIG. 3, a third timing belt pulley 59 is attached to the lower end of the shaft 47 and connected, via a second timing belt 60, to a fourth timing belt pulley 61. The first timing belt pulley 61 is attached to a hollow shaft 62. The hollow shaft 62 is supported concentrically with respect to the axis 34 in the base plate 32. A hook bearing 63 is mounted on the upper end of the hollow shaft 62. This forms a hook bearing drive 64 that moves the hook bearing 63 equiangularly with respect to the rotary housing 33.

Figure 4:
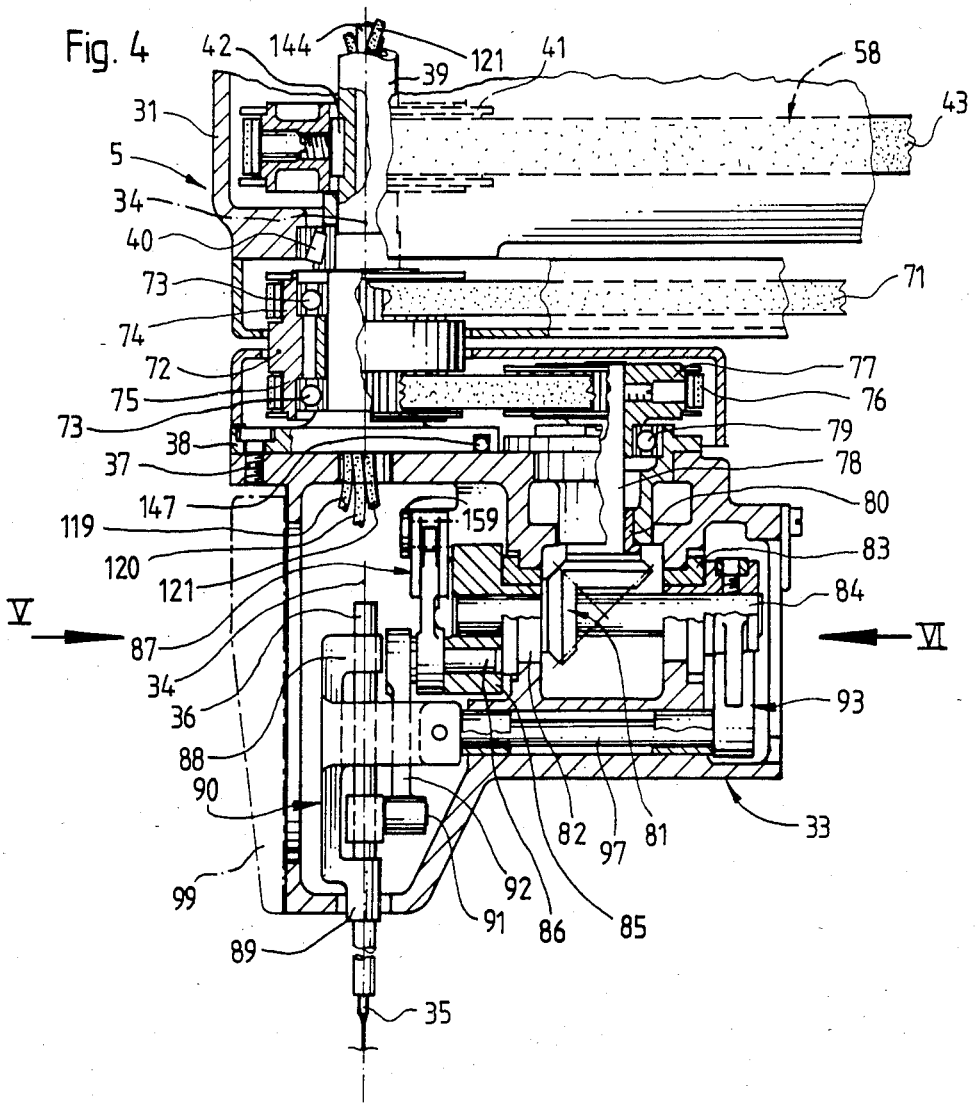
FIG. 4 is a vertical longitudinal center section through the rotary housing, on an enlarged scale with respect to FIG. 3.

Referring to FIGS. 3 and 4, the main drive shaft 15 is supported in a bearing 65 within the standard 30 drives via a bevel gear drive 66 a vertical shaft 69. The shaft 69 is supported in bearings 67 and 68 within the standard 30. At the upper end of the shaft 69 there is attached a fifth timing belt pulley 70 for driving via a fourth timing belt 71, a double timing belt pulley 72. The pulley 72 is connected to the shaft 39 by bearings 73 and is concentric with respect to the axis 34. The third timing belt 71 is guided around an upper part 74 of the double timing belt pulley 72. A fourth timing belt 76 is guided around a lower part 75 of the double timing belt pulley 72 to a sixth timing belt pulley 77. The sixth timing belt pulley 77 is mounted to a shaft 78. The shaft 78 is supported in bearings 79 and 80 within the rotary housing 33 and drives, via a bevel gear drive 81, a shaft 84. The shaft 84 is horizontally supported in bearings 82 and 83 in the rotary housing 33. The end of the shaft 84 adjacent to the needle bar 36 carries a crank 85 for driving, via a crank pin 86, a thread take-up drive mechanism 87 and the needle bar 36.

The needle bar 36 is supported in an upper bearing 88 and a lower bearing 89 of a needle bar bearing frame 90 and axially displaceable in longitudinal direction. Between the bearings 88 and 89 a drive bolt 91 is fastened to the needle bar 36. A crank lever 92 is rotatably arranged on the drive bolt 91 and connected to the crank pin 86 of the crank 85, so that the shaft 84 effects the oscillatory motion of the needle bar 36.

Figure 6:
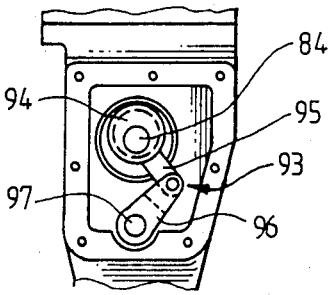
FIG. 6 is a side elevation of the rotary housing according to the arrow VI in FIG. 4, on a reduced scale with respect to FIG. 4.
Figure 11:
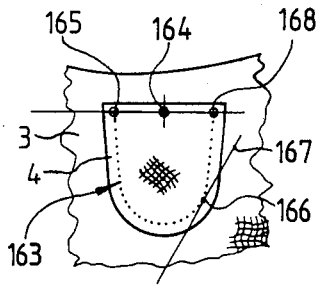
FIG. 11 shows a workpiece with a pocket cut sewn thereon.

Referring to FIGS. 4 and 6, the other end of the shaft 84, away from the needle bar 36, is provided with a jogging gear 93 having an eccentric 94 arranged on the shaft 84 and hingedly connected via a tie rod 95 to a crank 96. The crank 96 is secured to a shaft 97, which is supported below and parallelly with respect to the shaft 84 in the rotary housing 33. The needle bar bearing frame 90 is secured to the shaft 97, so that a vibratory motion (needle feed) is performed while the needle bar 36 moves up and down.

The rotary housing 33 has removable covers 98, 99 at the side of the jogging gear 93 and at the side of the needle bar 36.

Figure 5:
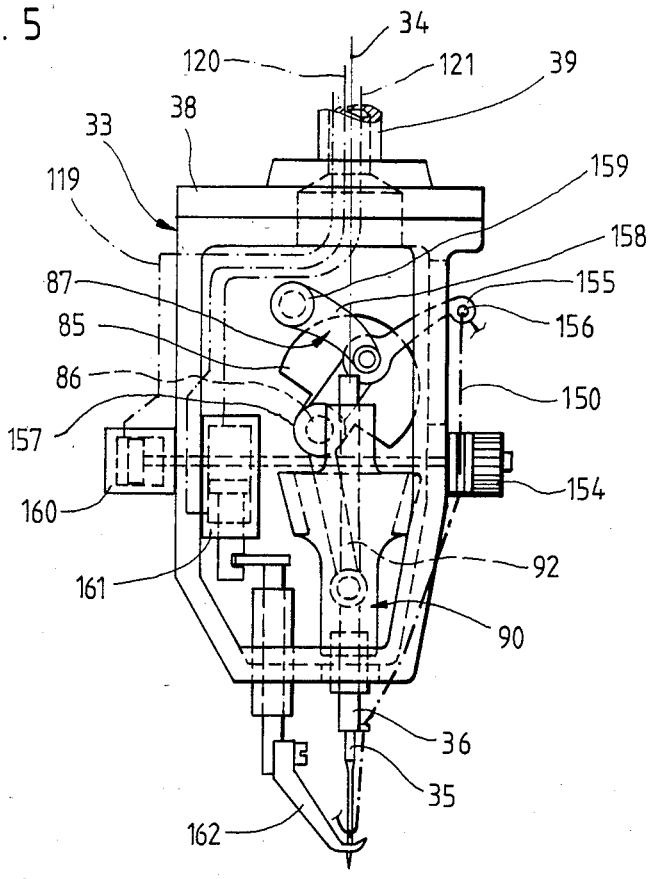
FIG. 5 is a side elevation of the rotary housing according to the arrow V in FIG. 4, on a reduced scale with respect to FIG. 4.
Figure 10:
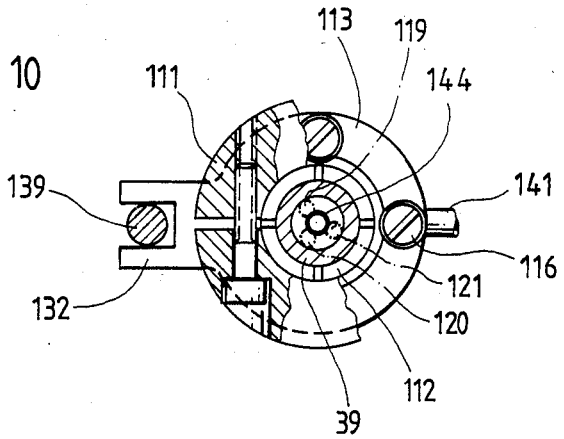
FIG. 10 is a cross section taken along line X—X in FIG. 7, on a reduced scale with respect to FIG. 7.

Referring to FIGS. 3 and 5, a seventh timing belt pulley 100 is attached to the lower end of the shaft 69. The seventh pulley 100 drives, via a fifth timing belt 101, an eighth timing belt pulley 102, which in turn is arranged on a hook shaft 103. The shaft 103 is supported in a hollow shaft 62. The hook shaft 103 drives a hook 106 having a horizontal axis of rotation, via a bevel gear drive 104 and a timing belt drive 105 supported in the hook bearing 63. The hook 106 is also supported in the hook bearing 63. The afore described total hook drive is denoted as 107. The drive derived from the timing shaft 69 via the timing belt 71 for driving the needle bar 36, the jogging gear 93 and the thread take-up drive mechanism 87 is denoted as 108.

The upper end of the hollow shaft 39 is pivoted in an axial-radial slide bearing 110 received in a bearing rib 109, which is arranged above the drive of the rotary housing 33 in the upper arm 31. The hollow shaft 39 is axially secured by a clamping ring 111 acting upon a flange bushing 112 located above the axial-radial slide bearing 110. The flange bushing 112 is at its upper end provided with a radially projecting flange 113, to which is secured the front end of a flange 114 by means of screws 116, at which the flange 114 is a part of a control shaft 115. By this construction it is achieved that the control shaft 115 is also coaxially arranged with respect to the axis 34 and positioned above the hollow shaft 39.

Figure 7:
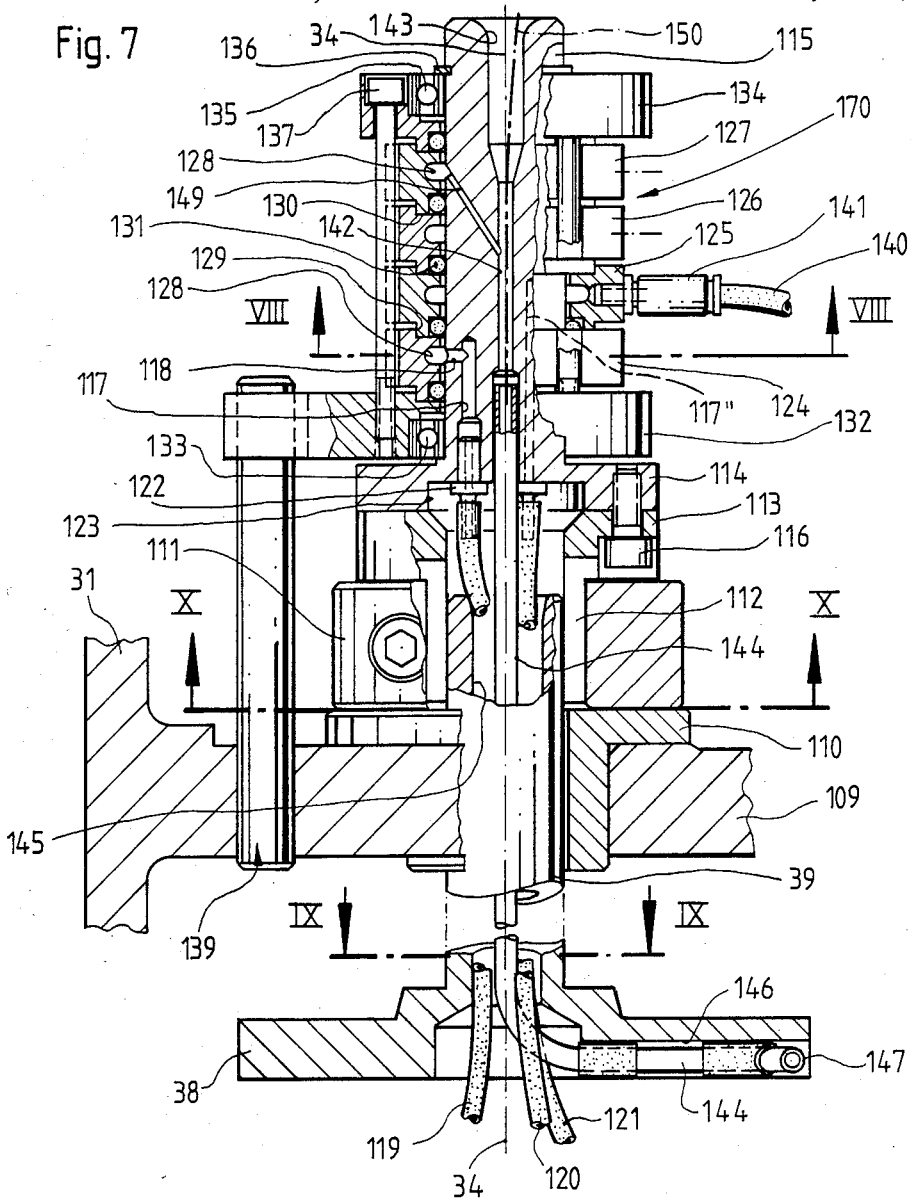
FIG. 7 is a partial section taken from the left upper side of FIG. 3 showing a rotary coupling according to the invention.
Figure 8:
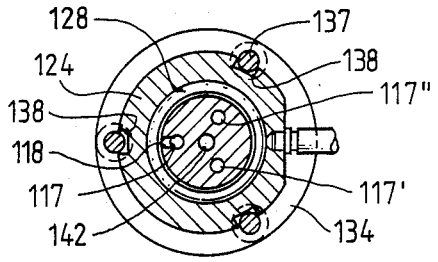
FIG. 8 is a horizontal section taken along line VIII—VIII of FIG. 7, on a reduced scale with respect to FIG. 7.
Figure 9:
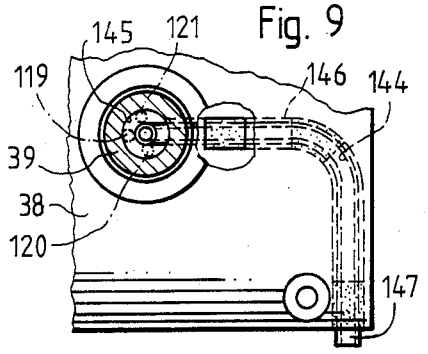
FIG. 9 is a partial cross section through FIG. 7 taken along line IX—IX.

In the control shaft 115 there are arranged some supply canals 117, 117', 117'', which extend in parallel to the axis 34 and which are formed by non-concentrically arranged sack holes provided with different axial extension. In FIG. 7 only the supply canal 117 is illustrated. Moreover, the supply canal 117 is opened by a bore 118 radially and outwardly extending. In similar manner the other supply canals are formed with corresponding bores.

To the supply canals 117, 117', 117'' there are each provided hose connections receiving hoses 119, 120, 121. In order to render possible this connection in the flange 114 there is formed a recess 123 receiving the hose connections 122 including the hoses 119, 120, 121 with sufficient clearance.

On the control shaft 115 there are arranged equally constructed supply rings 124, 125, 126, 127, which each are profiled at their inner circumference with an annular canal 128 flushing with the correspondent axial bore 118. Moreover, the supply rings 124 to 127 are each profiled at one front side with an axially projecting collar 129, which engages into a corresponding recess 130 situated in the supply ring placed next to it as an axial and radial determination. In this area each of the supply rings 124 to 127 is provided with an inner annular seal as to give a seal between the rings placed next to each other and as to give a seal to the outer atmosphere. Simultaneously, the annular seals are in contact with the outer circumference of the control shaft 115 finally assuring that the supply rings 124 to 127 are sealed to each other. This package of supply rings 124 to 127 rests at its lower front side on a first bearing cover 132 secured radially and axially with the flange 114 by means of a ball bearing 133. Onto the upper front end of the package of supply rings 124 to 127 abuts a second bearing cover 134, which is also pivoted on the control shaft 115 by means of an axial-radial ball bearing 135 which is axially secured by means of a retaining ring 136 with respect to the control shaft 115.

The second bearing cover 134 and the first bearing cover 132 are connected to each other by screws 137, which also extend through recesses 138 formed in the supply rings 124 to 127. Due to this construction the package of the supply rings 124 to 127 in conjunction with the first and second bearing covers 132, 134 are axially pressed together on one hand and as to assure that the supply rings 124 to 127 are non-tiltable with respect to the bearing covers 132, 134 on the other hand.

The first bearing cover 132 is non-rotatably secured with respect to the bearing rib 109 by means of a torsion protection 139 so that also the supply rings 124 to 127 are non-rotatably fixed versus the upper arm 31. The total package formed by the bearing covers 132, 134, the rings 124 to 127 and the control shaft 115 forms a pressurized-air-rotary coupling 170.

In each angular canal 128 of the supply rings 124 to 127 a hose 140, 140', 140'', 140''' terminates, at which each is connected to the supply ring 124 to 127 by means of a hose connection 141.

In the control shaft 115 there is concentrically formed with respect to the axis 34 a bore 142, which is profiled at its upper section with an enlarged inlet portion 143. At the lower end the control shaft 115 is provided with a tube 144 as an extension of the bore 142, at which the tube 144 extends downwardly through the inner bore 145 of the hollow shaft 39 in a similar manner like the hoses 119 to 121. The tube 144 is fastened to a flange 38 of the hollow shaft 39. For this purpose at the lower front side of the flange 38 there is formed a recess 146, in which the tube 144 is clampingly positioned. The tube end 147 terminates in the range of a thread-pre-tension 148 usually used for a coarse adjustment of the thread tension. Directly below of the inlet portion 143 there terminates an air-pressure canal 149, which is drilled in an angle downwardly into the bore 142. As already described the air-pressure canal 149 is connected to the annular canal 128 of the upper supply ring 127. If pressurized air is blown in here then at the junction of the air-pressure canal 149 and the bore 142 a Venturi effect is generated, so that a needle thread 150 fed into the bore 142 through the inlet portion 143 will be advanced resp. fed into the tube 144 until finally leaving the tube end 147. By the conjunction of the angularly arranged air-pressure canal 149 and the bore 142 thus a kind of Venturi nozzle is formed. The needle thread 150 is drawn of from a thread supply 151 in form of a spool and fed to the pre-tension 148 via the thread guides 152, 153, the inlet portion 143, the bore 142 and the tube 144. From here the needle thread 150 is fed to a thread take-up lever 155 as a part of the take-up drive mechanism 87 by passing a thread tensioner 154 serving for a fine adjustment of the thread tension. The thread take-up lever 155 is formed with two arms. At its upper end reaching out of the rotary housing 33 there is situated an eye 156. Its other lower end 157 is rotatably received on the crank pin 86. Moreover, the thread take-up lever 155 is linked at its middle pivot (not denoted) to one end of a link 158, the other end of which is tiltably pivoted on a bolt 159 stationarily arranged in the rotary housing 33.

The hoses 119, 120, 121 serve for the supply of pressurized air for different drives resp. drive motors. By the hose 119 a pneumatic cylinder 160 is supplied serving as to drive the thread tensioner 154 into a thread tension release position.

The hoses 120, 121 serve for the supply of a double acting pneumatic cylinder 161, which is applied as a drive in order to up and down moving a presser foot 162.

Operation is described as follows:

The grooves 20 and 23 of the control cam 7 of the feeding device 2 are profiled to correspond to the workpiece cut 4 (in this case a pocket cut) to be sewn onto the workpiece 3 by means of a seam 163. While the workpiece 3 together with the workpiece cut 4 is loaded resp. removed, the needle 35 is positioned with respect to the workpiece holder 29 in an intermediate point 164 (FIG. 7). This intermediate point 164 is reached by moving the workpiece 3 together with the workpiece cut 4 to the intermediate point 164 after termination of the seam 163 and without sewing from the end point 119 of the seam 163. While the workpiece holder 29 together with the workpiece 3 and the workpiece cut 4 moves from the end point 165 to the intermediate point 164, the rotary housing 33 and the hook bearing 63 are returned into a neutral starting position due to the correspondingly profiled groove 57 -FIG. 3. The needle feed motion is performed extending in a vertical plane with respect to the plane of the drawing as it is commonly known from sewing machines provided with a feed drive. The action of the jogging gear 93 causes a superposition of the oscillatory motion of the needle 35 with a vibratory motion of the needle bar bearing frame 90, so that the not illustrated point of the needle 35 performs a closed elliptical path, i. e. the needle 35 performs the already described needle feed motion. The needle 35 receives in its upper respectively lower dead center of the elliptical path a usual vertically directed position, which corresponds to the axis 34. The largest angle of deviation of the needle 35 with repsect to the axis 34 measures about 1°.

The feeding device 2 continuously displaces the workpiece holder 29 in such a manner, that the workpiece 3 together with the workpiece cut 4 is moved relative to the needle 35 according to the course of the seam 163. Due to the groove 57, the drive 58 of the rotary housing 33 causes, the needle feed motion to be performed at each stitching point 166 in a tangential direction 167 with respect to the seam 163 as shown in FIG. 7. The hook bearing drive 64 ensures that the hook 106 is always positioned in the right order. While sewing the seam 163 from the seam starting point 168 to the seam end point 165, the workpiece 3 together with the workpiece cut 4 is exposed to a minimum of displacing forces.

Figure 2:
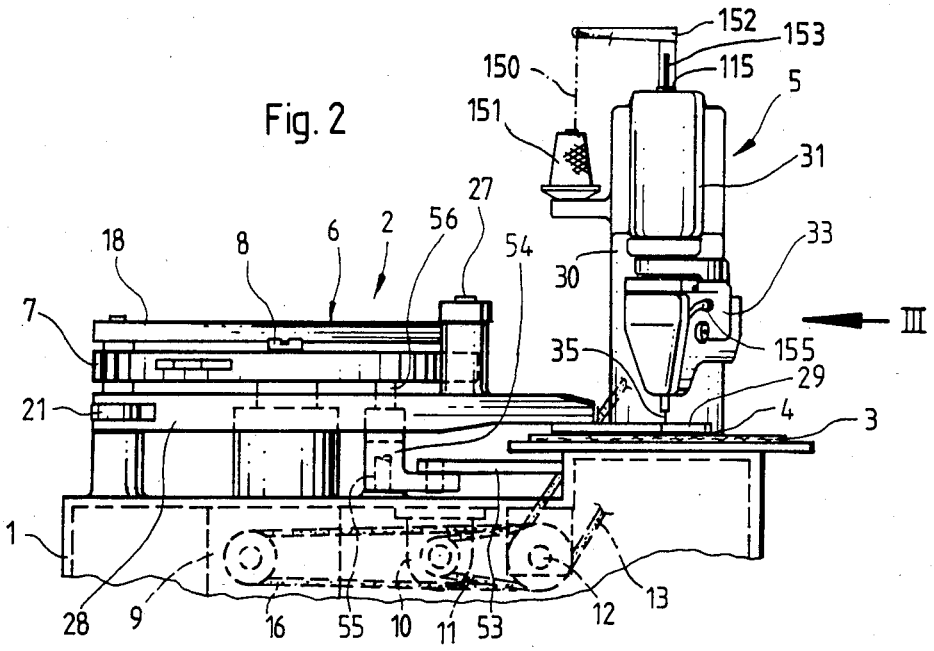
FIG. 2 is a front view of the automatic sewing device according to the arrow II in FIG. 1.

While the rotary housing 33 is rotated, the thread take-up lever 155 is rotated. Also the thread supply is not subject to alterations because the thread 150 is guided through the hollow shaft 39 and the thread spool 151 is commonly rotated with the hollow shaft 39. In FIGS. 1 and 2 there is illustrated how the rotary housing 33 is turned by an angle d at the stitching point 120 (FIG. 7) for reaching the tangential direction with respect to the normal position.

Due to the provision of the rotary coupling 170 as described also the supply of different drives connected to the rotary housing 33 with compressed air is assured without any limitations as to the rotatability of the housing 33.

I claim:

1. A sewing device having:

a sewing head;

a feeding means for producing a two-axis relative movement between said sewing head and a workpiece to be sewn;

a main drive shaft;

a supply of a thread;

said sewing head including:

a housing rotatably pivoted at said sewing head by means of a hollow shaft having an axis of rotation, said housing including:

a crank means driven by said main drive shaft;

a needle bar pivotally received and reciprocatingly driven by said crank means;

a needle fastened to said needle bar, said needle receiving said thread and longitudinally extending about said axis;

thread control means;

an up and downwardly movable presser foot; and drive means operating said presser foot, said thread being fed from said supply through said hollow shaft to said thread control means, and said drive means being supplyable with energy by at least one supply line from the outside, and a rotary coupling means concentrically provided to said hollow shaft and having:

at least one supply line for said energy; and a coaxial bore for said thread.

2. A sewing device according to claim 1, wherein said energy is supplied by means of compressed air, said rotary coupling means further having:

a canal directed towards said rotary housing and terminating in said coaxial bore for said thread, said canal being connected to a supply line.

3. A sewing device having:

a sewing head;

a feeding means for producing a two-axis relative movement between said sewing head and a workpiece to be sewn;

a main drive shaft;

a supply of a thread;

said sewing head including:

a housing rotatably pivoted at said sewing head by means of a hollow shaft having an axis of rotation, said housing including:

a crank means driven by said main drive shaft;

a needle bar pivotally received and reciprocatingly driven by said crank means;

a needle fastened to said needle bar, said needle receiving said thread and longitudinally extending about said axis;

thread control means including a thread tensioner controllable by a first drive;

an up and downwardly movable presser foot; and a second drive operating said presser foot;

said thread being fed from said supply through said hollow shaft to said thread control means, and said first and second drives being supplyable with energy by at least one supply line from the outside; and a rotary coupling means concentrically provided to said hollow shaft and having at least one supply line for said energy and a coaxial bore for said thread.

4. A sewing device according to claim 3, wherein said first and said second drives are operated by compressed air, said rotary coupling means further having:

supply hoses and connecting hoses, said supply hoses being nonrotatably arranged with respect to said sewing head, and said connecting hoses being nonrotatably arranged with respect to said rotary housing and being led through said hollow shaft to said first and said second drives.

5. A sewing device having:

a sewing head;

a feeding means for producing a two-axis relative movement between said sewing head and a workpiece to be sewn;

a main drive shaft;

a supply of a thread;

said sewing head including:

a hollow shaft with an axis of rotation pivotally received in said sewing head;

a housing secured to the lower end of said hollow shaft;

said housing including:

a crank means driven by said main drive shaft;

a needle bar pivotally and reciprocatingly driven by said crank means;

a needle fastened to said needle bar, said needle receiving said thread and longitudinally extending about said axis, thread control means; and drive means controlling auxiliary functions, said thread being fed from said supply through said hollow shaft to said thread control means, and said drive means being supplyable with energy by at least one supply line from the outside; and a rotary coupling for feeding through said energy in form of compressed air from the outside to said drive means, said rotary coupling comprising:

a cylindrical control shaft coaxially and firmly connected to the upper end of said hollow shaft, said control shaft being formed with a coaxial bore for said thread;

individual supply canals each formed in said control shaft by a sack hole parallelly provided to said coaxial bore and by a radial bore, and supply rings each formed with an annular groove and a supply hose, said supply rings being pivotally received on said control shaft and sealed off to each other and with respect to said control shaft by gasket means, each of said annular grooves cooperating with one of said radial bores, said supply rings being kept stationarily with respect to said sewing head, and each of said drive means being individually connected to one of said supply hoses for leading through said compressed air individually controlled.

6. A sewing device according to claim 1 wherein said housing is provided with at least one further drive for auxiliary functions, said rotary coupling means further having at least one further drive supply and connecting hoses for said auxiliary functions.

7. A sewing device according to claim 2 wherein said housing is provided with at least one further drive for auxiliary functions, said rotary coupling means further having at least one further drive supply and connecting hoses for said auxiliary functions.

* * * * *